US005486005A

United States Patent [19]

Neal

[11] Patent Number: 5,486,005

[45] Date of Patent: Jan. 23, 1996

[54] METHOD AND APPARATUS FOR PLAYING A POKER-LIKE GAME

[75] Inventor: Michael D. Neal, Bloomington, Ill.

[73] Assignee: Judith Neal, Executrix, Bloomington, Ill.

[21] Appl. No.: 367,835

[22] Filed: Jan. 3, 1995

[51] Int. Cl.[6] ..... A63F 1/00

[52] U.S. Cl. ..... 273/292; 273/309; 273/274

[58] Field of Search ..... 273/292, 309, 273/274

[56] References Cited

U.S. PATENT DOCUMENTS

| | | | |
|---|---|---|---|
| 4,364,567 | 12/1982 | Goott | 273/237 |
| 4,492,378 | 1/1985 | Williams | 273/142 HA |
| 4,836,553 | 6/1989 | Suttle et al. | 273/292 |
| 4,861,041 | 8/1989 | Jones et al. | 273/292 |
| 5,022,653 | 6/1991 | Suttle et al. | 273/85 CP |
| 5,042,818 | 8/1991 | Weingardt | 273/292 |
| 5,118,114 | 6/1992 | Tucci | 273/274 |
| 5,154,429 | 10/1992 | LeVasseur | 273/292 |
| 5,184,821 | 2/1993 | Korenek | 273/138 A |
| 5,248,142 | 9/1993 | Breeding | 273/138 R |
| 5,257,810 | 11/1993 | Schorr et al. | 273/292 |
| 5,265,882 | 11/1993 | Malek | 273/292 |
| 5,275,400 | 1/1994 | Weingardt et al. | 273/85 CP |
| 5,275,415 | 1/1994 | Wisted | 273/274 |
| 5,294,128 | 3/1994 | Marquez | 273/292 |
| 5,356,140 | 10/1994 | Dabrowski et al. | 273/85 CP |
| 5,382,025 | 1/1995 | Sklansky et al. | 273/292 |
| 5,390,934 | 2/1995 | Grassa | 273/292 |

*Primary Examiner*—Benjamin H. Layno
*Attorney, Agent, or Firm*—Lloyd D. Zickert; Adam H. Masia

[57] ABSTRACT

A method and apparatus for playing a poker-like game with a deck of fifty-two playing cards wherein each player plays against the dealer. After each player makes a wager, the dealer deals four initial cards of the deck face up to seven separate hands, places odds on each hand according to predetermined guidelines, and selects two of the seven hands as a combination field position. Each player then selects either one of the hands, the field position, or a no-hand winning position which requires that none of the seven hands, after all cards are dealt, have two pairs or better. After each player selects a hand or a position, the dealer deals three more cards of the deck face up to each of the seven separate hands. The dealer then determines the winning hand or position and pays each player who selected the winning hand or position according to the odds and their wager or collects each player's wager who did not select the winning hand or position. Additionally, a jackpot wheel may be included to permit an added possibility of winning a larger payout.

19 Claims, 3 Drawing Sheets

METHOD AND APPARATUS FOR PLAYING A POKER-LIKE GAME

DESCRIPTION

This invention relates in general to a method and apparatus for playing a game, and more particularly to a method and apparatus for playing a poker-like game with a deck of cards wherein each player plays against the dealer.

BACKGROUND OF THE INVENTION

Heretofore it has been well known to play a variety of different games with a standard deck of fifty-two playing cards, including Blackjack, Poker, Bridge, Gin Rummy, etc. Games such as Blackjack are universally played in casinos and other such establishments because each player plays against the dealer or house and because they provide an edge to the dealer or house. Likewise, video draw poker machines in which a player individually plays against the house are widely found in casinos. In the video draw poker games there is an advantage to the house because the player needs a hand having a pair of Jacks or better to win. Other poker games, such as Seven-Card Stud, are not generally played in casinos because the rules of Poker require players to play against each other instead of each player playing against a single dealer or the house. The casinos are thus unable to profit from running such games. Moreover, in most poker games each player has one hand even though some variations allow the players to share certain cards. This limits the excitement of such games especially when a player initially receives a poor hand. In one known poker game, a draw poker machine gives the player two initial hands from two separate decks, and the player must select one of those hands to play while the other hand is discarded. U.S. Pat. No. 5,356,140 illustrates this game. While this game allows the player to select or play from one of two hands, it does not maintain the other hand in the game, and it does not allow another player to select the other hand. Accordingly, there is a need for an exciting poker-like game in which each player plays against the dealer or the house and in which each player can select his hand or a position after seeing a predetermined number of cards dealt to each hand.

SUMMARY OF THE INVENTION

The present invention overcomes the above problems in providing a method of and apparatus for playing a poker-like game utilizing a deck of fifty-two playing cards wherein each player plays against the dealer or the house. The present invention can be utilized at a casino table with a limited number of players, on a video machine with one or more players depending on the size of the machine (or one player making different wagers), on a large video screen with an unlimited number of players like Keno, or as a home board game with a limited number of players.

Generally, the method of the present invention requires each player to make a bet or wager to participate in a round dealt by the dealer. After each player makes a wager, the dealer deals a predetermined like number of initial cards from a standard deck of fifty-two playing cards to a predetermined number of hands. These cards are preferably dealt face up showing the value of each card. The preferred embodiment of the present invention calls for four initial cards to be dealt face up to seven hands; however, the number of initial cards dealt and the number of hands could vary. After the initial cards are dealt, the dealer places odds on each hand according to predetermined guidelines set by the house.

An option, if desired by the house, allows the dealer to select two or more of the hands for combination as a field position. If a player chooses the field position instead of one of the hands, and either of the hands selected as part of the field position wins, then the player wins. The odds for winning the field position may be the odds previously selected for each hand or may be new odds placed on the field position by the dealer.

After the dealer selects the odds for each hand, and the field position if being utilized, each player selects one of the hands, the field position, or a no-two-pair-or-better position. The no-two-pair-or-better position, which may also be referred to as a no-hand winning position, requires that none of the hands, after all the cards are dealt, have two pairs or better according to the conventional rules of Poker. The conventional rules of Poker set the order of hands in descending order as follows: Straight Flush, Four of a Kind, Full House, Flush, Straight, Three of a Kind, Two Pairs, a Pair, and Highest card.

After each player selects a hand or a position, the dealer deals a predetermined like number of additional cards from the deck face up to each of the hands, such that each hand has at least five cards from which a poker hand can be formed. In the preferred embodiment where four cards are initially dealt, three additional cards are dealt to each hand after all of the players have selected their hands or positions; thus, leaving each player with seven cards.

The dealer then determines the winning hand or position according to the predetermined rules of Poker. The dealer pays each player who selected the winning hand or position according to the odds placed on that hand or position and the player's wager. The dealer also collects the wager of each player who did not select the winning hand or position.

Variations of the method and apparatus for playing the game of the present invention are contemplated as described below. One such variation includes the use of a jackpot wheel that determines the hand needed to win the jackpot.

It is therefore an object of the present invention to provide a method of and apparatus for playing a poker-like game in which each player plays against the dealer or the house.

Another object of the present invention is to provide a poker-like game in which each player plays against the dealer or the house and in which each player can select a hand after seeing a predetermined number of initial cards dealt by the dealer.

Another object of the present invention is to provide a poker-like game in which each player plays against the dealer or the house and after seeing the initial card dealt each player can select a hand or a position that no hand will be a winning hand.

A further object of the present invention is to provide a poker-like game in which each player plays against the dealer or the house and in which each player can select a field position that includes at least two hands after seeing the initial cards dealt.

A further object of the present invention is to provide a poker-like game in which each player plays against the dealer or the house and in which the dealer activates a jackpot wheel which determines the hand necessary to win the jackpot.

Other objects, features and advantages of the invention will be apparent from the following detailed disclosure, taken in conjunction with the accompanying sheets of drawings, wherein like reference numerals refer to like parts.

DESCRIPTION OF THE INVENTION

The present invention includes a method and apparatus for playing a poker-like game with a standard deck of fifty-two playing cards wherein each player plays against a dealer who represents a house or casino. The present invention can be utilized in several forms such as at a casino table with one or more players depending on the size of the table, in a computer video machine game with one or more players depending on the size of the machine, on a large screen or television monitor with an unlimited number of players like Keno, as a home television/computer video game, or as a board game.

Figure 1:
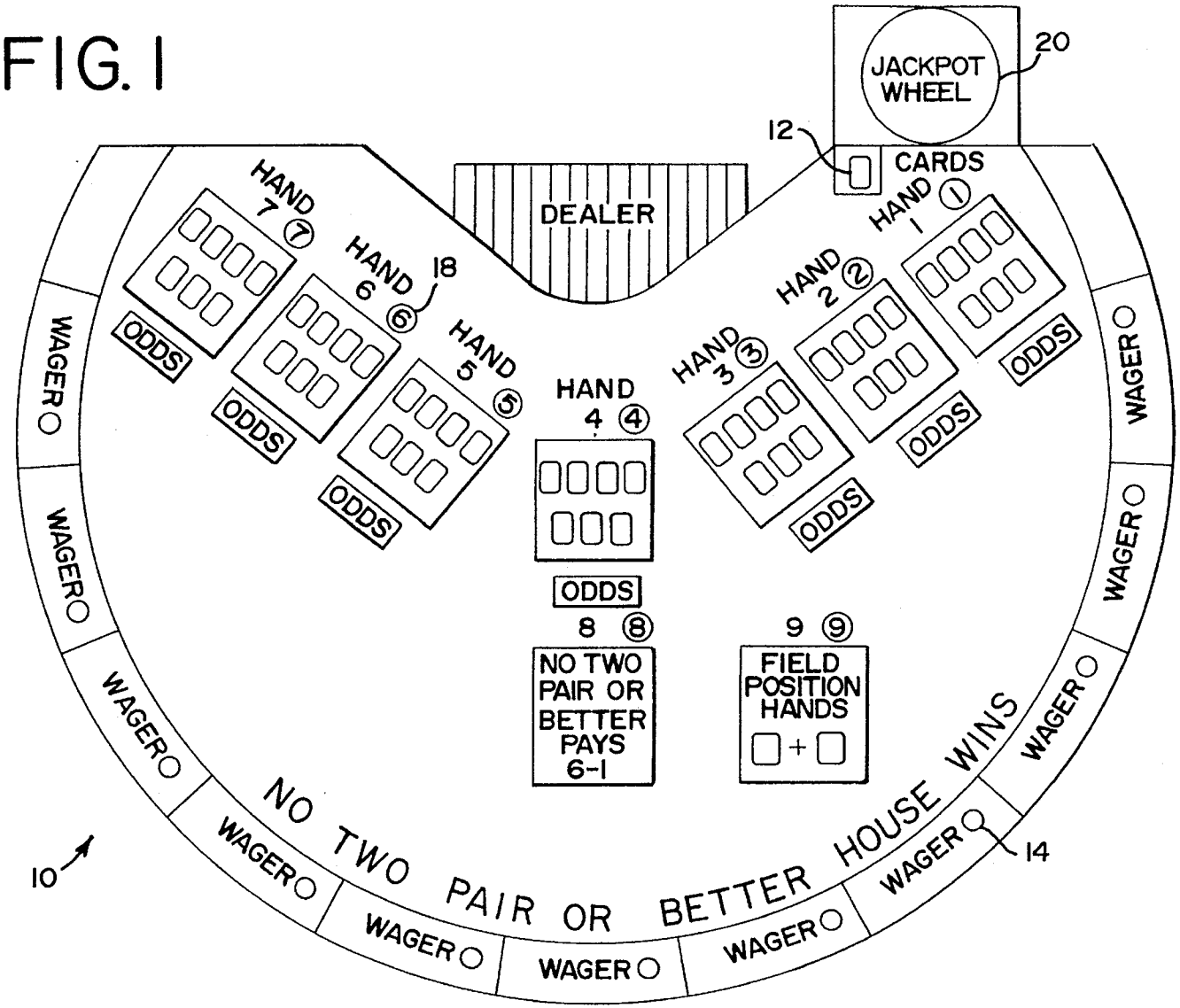
FIG. 1 is a top plan view of a table or board layout of the present invention.
Figure 2:
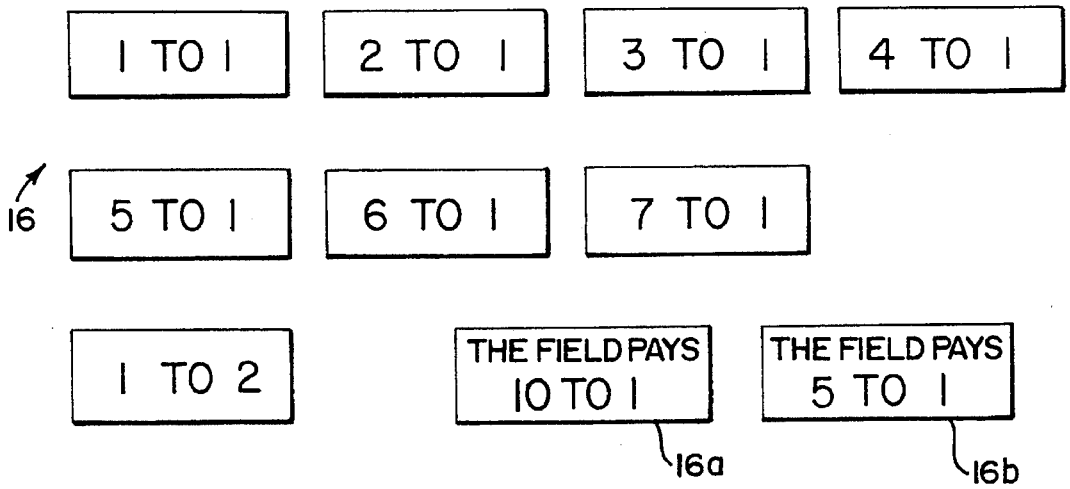
FIG. 2 is an enlarged top plan view of the odds-indicating cards.
Figure 3:
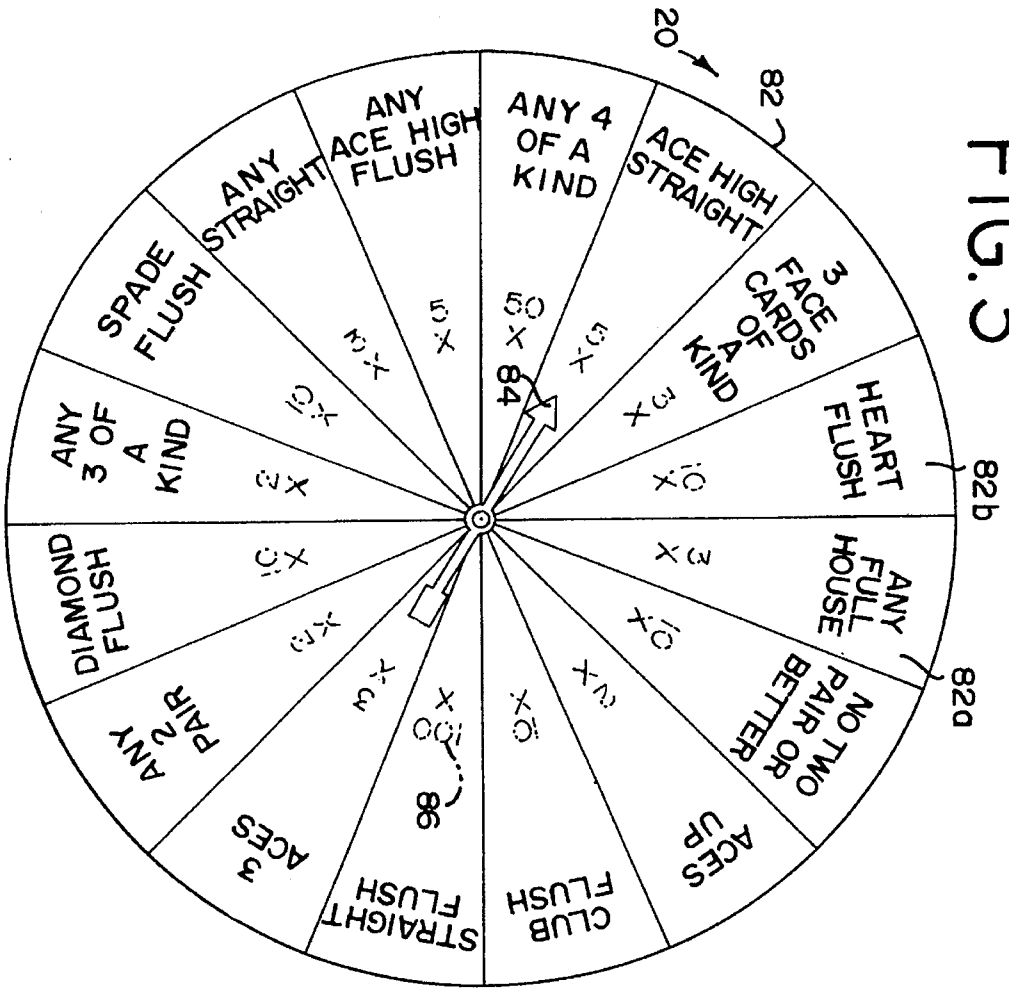
FIG. 3 is a top plan view of a jackpot wheel of the present invention.
Figure 4:
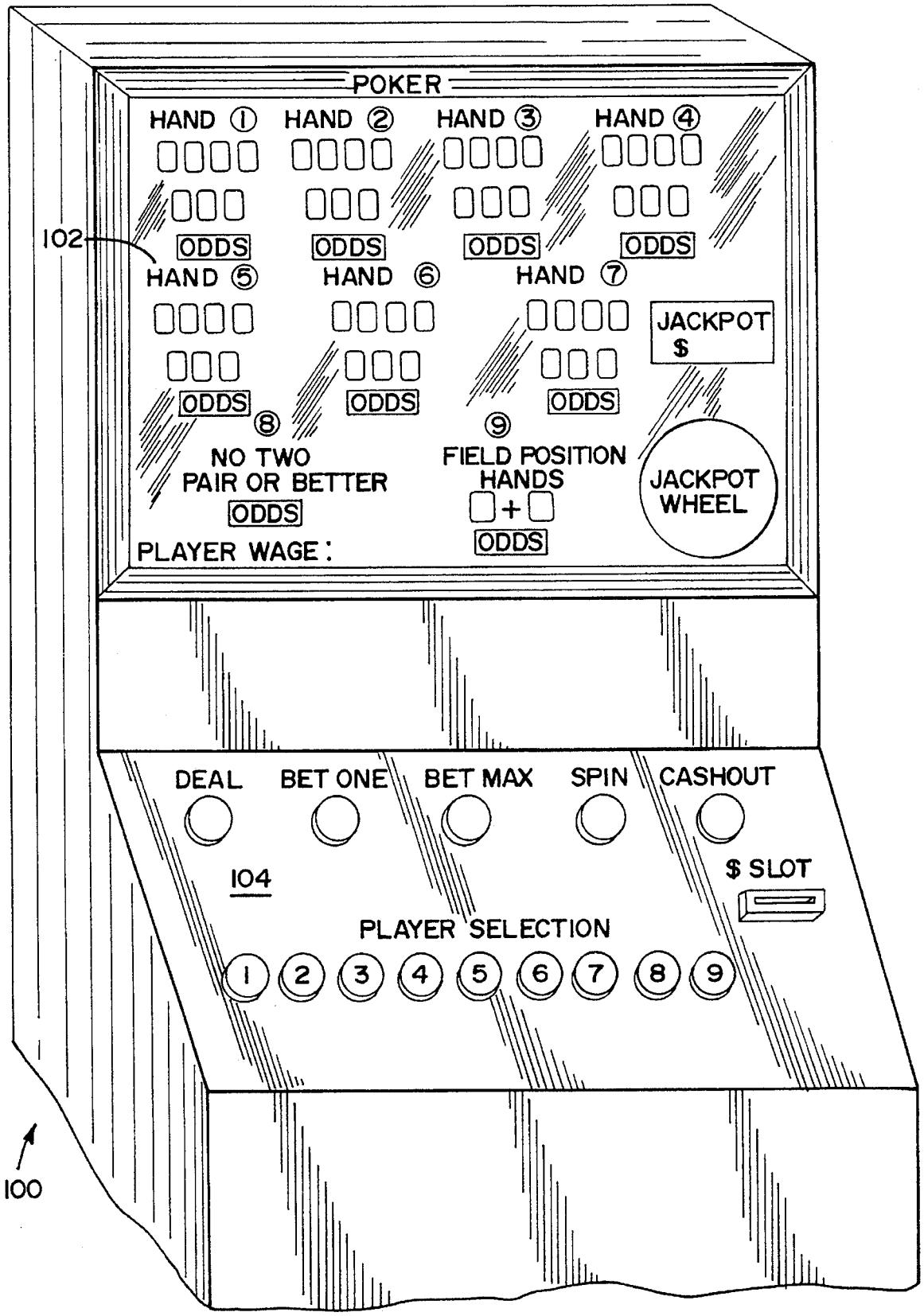
FIG. 4 is a perspective view of a computer video machine embodying the present invention.

Referring now to FIGS. 1 to 3, the apparatus of the present invention includes a casino table or board 10, a standard deck of fifty-two playing cards 12, tokens, coins, or chips 14 for wagering, odds-indicating cards 16, color-coordinated hand/position indicating chips 18 numbered 1 through 9, and a jackpot wheel 20. More specifically, the standard deck of playing cards 12 includes cards numbered 2 to 10, Jack, Queen, King, and Ace in each of the four suits Clubs, Diamonds, Hearts and Spades. To begin a round of play, the cards 12 are shuffled or mixed by the dealer and each player makes an initial bet or wager using the tokens, coins, or chips 14 to participate in the round. The wager may be limited by a minimum or maximum depending upon the rules of the house. The players place their wagers on the table 10 in the area labeled "WAGER" which is directly in front of each player position. After the players make their wagers, the wagers cannot be changed or removed from the table except by the dealer until the round is over.

After all the players make wagers, in the preferred embodiment, the dealer deals four initial cards of the deck face up to the seven hands in a conventional manner (i.e., dealing one card to each hand sequentially, four times). These cards are respectively positioned on the table in each of the areas labeled "HAND 1" to "HAND 7" and in the four designated card positions in each hand closest to the dealer. In addition to being numbered, each hand may be associated with a different color. For example, HAND 1 may be red, HAND 2 may be orange, HAND 3 may be yellow, HAND 4 may be green, HAND 5 may be blue, HAND 6 may be black, and HAND 7 may be white. This helps to distinguish the play selection, as described below. The color may be within the area for the hand, the numerical designation for the hand, or wherever desired. These colors also correspond to the color-coordinated hand/position indicating chips 18.

After the initial four cards are dealt, the dealer determines the odds for each of the seven hands according to predetermined rules of the house. These odds may differ depending on the house rules, the winning percentages of each hand, and, of course, the cards shown in each of the hands dealt. After determining the odds, the dealer then indicates the odds for each hand by placing an odds-indicating card 16, as shown in FIG. 2, on the table in each of the areas labeled "ODDS" which are located adjacent to the each of the seven hands. The odds-indicating card adjacent each hand shows the players the payoff of each hand if that hand wins. Alternatively, the odds could be calculated and/or displayed through electronic means or in any other suitable fashion.

After associating the odds with each hand, in one of the embodiments, the dealer may select two of the seven hands for a combination as a field position. The dealer does this by placing the color-coordinated hand/position indicating chips 18 corresponding to the two hands selected to be the field position in the designated boxes of the area numbered 9 and labeled "FIELD POSITION HANDS." In addition to being colored the same as the hand color, each hand/position indicating chip is numbered with the appropriate hand or position number to indicate the HAND or position with which it corresponds. The field position generally consists of the two hands with the least chance of winning which also usually happen to be the hands with the highest odds. The dealer may leave the odds associated with each of the hands of the field position as is, or may use an odds-indicating card for a different or new odds selection, such as **16*a* or 16*b* shown in FIG. 2**, to indicate new odds for the entire field position selection. If a player chooses to accept the field position, and either hand selected by the dealer as part of the field position wins, then the player wins and is paid according to the odds. It should be appreciated that if the house desires, it could eliminate the field position bet altogether.

After the dealer selects the odds for each hand and picks the two hands of the field position, each player must select one of the seven hands, the field position, or a no-two-pair-or-better position. A no-two-pair-or-better position requires that none of the seven hands, after all the initial and additional cards are dealt, have two pairs or better according to the conventional rules of Poker. If this position is selected by a player, and none of the seven hands have two pair or better, then the player wins and is paid off according to the preselected odds. This requirement can be increased or decreased, and the odds can be changed, depending on the winning percentage desired by the house. A player selects one of the hands, the field position, or the no-two-pair-or-better position by telling the dealer which hand or position he or she wants. The dealer then places a color-coordinated numbered hand/position indicating chip 18 corresponding to the hand or position selected by the player on the top of the player's wager. For convenience, the no-two-pair-or-better position corresponds to number "8" and the field position corresponds to number "9." This procedure verifies the player selection. The player selection of the hand or position could be accomplished in suitable alternative manners. Under the present invention, more than one player can select any of the seven hands, the field position, or the no-two-pair-or-better position. In fact, an unlimited number of players can select any hand or position, provided, of course, that they have made the initial wagers before any of the initial cards are dealt.

At the discretion of the house, the chance of winning a jackpot may be included in the game. The jackpot may be a fixed single amount, a multiple of the players bet, or may be a progressive jackpot. The jackpot may start out with any predetermined amount and may remain constant for a number of hands or may build by increments upon the completion of each hand in which no one wins the jackpot, depending on the predetermined rules of the house. The jackpot may also be determined by the percent of money won by the house over a set time period or number of hands. The jackpot-winning hand may be determined by a jackpot wheel 20, as further illustrated in FIG. 3. The jackpot wheel 20 includes a stationary circular plate 82 which is divided into a plurality of pie-shaped areas or sections, and each section may indicate a general or specific hand. For example, section 82*a* indicates "ANY FULL HOUSE" while section 82*b* indicates "HEART FLUSH" It will be appreciated that the number of sections and the type of hands indicated therein may vary according to the house rules of a casino. The jackpot wheel also includes a spinning arrow 84 rotatably mounted at the center of the circular plate 82 in a suitable manner. After the players have selected their hands or positions to determine the jackpot-winning hand, the spinning arrow is activated and the section on which the arrow lands is designated the jackpot-winning hand. Alternatively, various other types of jackpot wheels or other random indicating mechanisms, including a roulette-type wheel or a computer-generating jackpot-winning hand, could be utilized.

If the winning hand of the round is also the jackpot-winning hand, the player who selected that hand wins the jackpot or a percentage of the jackpot depending on the house rules. If more than one player has selected the winning hand of the round, the jackpot is divided equally among the players who selected the winning hand. The jackpot increases the excitement of the game by giving the players a chance to win a much larger sum than through normal odds and which may or may not depend on the amount wagered. For instance, the wheel in FIG. 3 may additionally indicate payoff values 86 shown in phantom in each section for each winning hand which are multiplied by the winning player's wager to obtain the jackpot payoff. Alternatively, if the game is being played casino-wide, different wagers could be linked to different size jackpots as desired by the house. Also, if desired by the house, when the winning hand of the round is not the jackpot-winning hand, a player who selected a hand which is the jackpot-winning hand could be awarded a payoff or a percentage of the jackpot. This alternative rewards the player who selected a losing hand which turns out to be the jackpot-winning hand.

After the players select their hands or positions, and if being used, after the jackpot-winning hand is determined, the dealer deals three additional cards of the deck face up to each of the hands placing those cards in the three designated card areas in each area labeled "HAND 1" to "HAND 7". After all of the cards are dealt, the dealer determines the winning hand or position according to the predetermined rules of order and pays each player who selected the winning hand or position according to the odds corresponding to that hand or position and the player's wager. The dealer also collects each player's wager who did not select the winning hand or position.

The present invention is demonstrated by the following examples of play, wherein numerals 2 to 10 represent cards two to ten, J represents the Jack, Q represents the Queen, K represents the King, A represents the Ace, ♣represents the Club Suit, ♠represents the Spade Suit, ♥ represents the Heart Suit, and ♦ represents the Diamond Suit.

EXAMPLE 1

In this example, there are five players in the game and each player wagers 10 units to begin the round. The dealer then deals the following cards to each hand:

| | INITIAL CARDS | | | | ODDS | FINAL CARDS |
|---|---|---|---|---|---|---|
| HAND 1 | 3♥ | 9♠ | A♠ | Q♦ | 3-1 | |
| HAND 2 | 4♥ | 10♥ | 3♠ | 8♥ | 2-1 | |
| HAND 3 | K♦ | K♣ | 6♠ | 6♦ | 1-1 | |
| HAND 4 | 6♥ | A♥ | K♠ | 10♦ | 4-1 | |
| HAND 5 | 7♠ | 7♣ | 5♣ | 4♣ | 1-1 | |
| HAND 6 | J♣ | 3♣ | J♠ | J♥ | 1-2 | |
| HAND 7 | 2♣ | 8♦ | 4♠ | 5♠ | 5-1 | |

After dealing the cards, the dealer places the above odds-indicating cards next to each hand. The odds are determined by the likelihood of each hand being the winning hand based on the cards dealt. For instance, since HAND 6 has three Jacks, it has the lowest payoff odds. The field position is then selected by the dealer as HAND 4 and HAND 7 because they have the least chance of winning. The players then select their hands or position. In this example, Players 1, 2, 4, and 5 select HAND 6, while player 3 selects HAND 3, which has a pair of Kings and a pair of Sixes. The dealer would place a hand/position indicating chip on the top of or next to each player's wager. The jackpot wheel is then activated and the jackpot-winning hand is determined to be "ANY FOUR OF A KIND." The final cards are then dealt as follows:

| | INITIAL CARDS | | | | ODDS | FINAL CARDS | | |
|---|---|---|---|---|---|---|---|---|
| HAND 1 | 3♥ | 9♠ | A♠ | Q♦ | 3-1 | 5♥ | 4♦ | 10♣ |
| HAND 2 | 4♥ | 10♥ | 3♠ | 8♥ | 2-1 | 5♦ | 7♥ | A♣ |
| HAND 3 | K♦ | K♣ | 6♠ | 6♦ | 1-1 | 7♦ | Q♣ | 2♠ |
| HAND 4 | 6♥ | A♥ | K♠ | 10♦ | 4-1 | 9♣ | 10♠ | 6♣ |
| HAND 5 | 7♠ | 7♣ | 5♣ | 4♣ | 1-1 | 8♠ | 9♦ | 8♠ |
| HAND 6 | J♣ | 3♣ | J♠ | J♥ | 1-2 | Q♥ | 9♥ | K♥ |
| HAND 7 | 2♣ | 8♦ | 4♠ | 5♠ | 5-1 | 2♦ | 2♣ | 3♦ |

The winning hand is HAND 6 with the highest three of a kind, beating HAND 7. Accordingly, players 1, 2, 4, and 5, who each selected HAND 6 win 15 units based on their wager of 10 units and the odds of 1–2. Player 3, who did not select HAND 6 loses his 10 units. No one wins the jackpot because the jackpot-winning hand was "ANY FOUR OF A KIND."

EXAMPLE 2

In this example, there are five players in the game and player 1 wagers 5 units, player 2 wagers 10 units, player 3 wagers 15 units, player 4 wagers 20 units, and player 5 wagers 25 units to begin the round. The dealer deals the following initial cards to each hand:

| | INITIAL CARDS | | | | ODDS | FINAL CARDS |
|---|---|---|---|---|---|---|
| HAND 1 | 2♠ | 5♥ | 3♠ | 5♣ | 3-1 | |
| HAND 2 | A♣ | 5♦ | 6♦ | 8♥ | 3-1 | |
| HAND 3 | 2♥ | K♣ | 4♥ | 10♥ | 2-1 | |
| HAND 4 | 5♠ | Q♠ | 6♠ | 9♠ | 1-1 | |
| HAND 5 | A♠ | 3♥ | 4♣ | 7♦ | 4-1 | |
| HAND 6 | 9♦ | 4♠ | K♠ | 10♦ | 4-1 | |
| HAND 7 | 6♣ | 3♦ | Q♥ | 2♦ | 5-1 | |

After dealing the cards, the dealer places the above odds-indicating cards next to each hand. The field position is then selected by the dealer as HAND 5 and HAND 7. The players then select their hands or position. In this example, players 1 and 2 select HAND 4, players 3 and 4 select HAND 3, and player 5 selects POSITION 8 which wins if "No Two Pair Or Better" shows up. The jackpot wheel is then activated and the jackpot-winning hand determined to be a "HEART FLUSH." The final cards are then dealt as follows:

| | INITIAL CARDS | | | | ODDS | FINAL CARDS | | |
|---|---|---|---|---|---|---|---|---|
| HAND 1 | 2♠ | 5♥ | 3♠ | 5♣ | 3-1 | J♣ | 9♣ | A♥ |
| HAND 2 | A♣ | 5♦ | 6♦ | 8♥ | 3-1 | 7♣ | 6♥ | J♦ |
| HAND 3 | 2♥ | K♣ | 4♥ | 10♥ | 2-1 | 9♥ | 2♣ | K♥ |
| HAND 4 | 5♠ | Q♠ | 6♠ | 9♠ | 1-1 | 10♠ | A♦ | J♥ |
| HAND 5 | A♠ | 3♥ | 4♣ | 7♦ | 4-1 | 8♦ | 8♣ | 10♣ |
| HAND 6 | 9♦ | 4♠ | K♠ | 10♦ | 4-1 | 7♥ | K♦ | 4♦ |
| HAND 7 | 6♣ | 3♦ | Q♥ | 2♦ | 5-1 | 8♠ | 3♣ | Q♦ |

The winning hand is HAND 3 with a King-high heart flush, which beats HAND 4 which has a Queen-high flush. Accordingly, player 3 wins 30 units based on his bet of 15 units and the 2 -to-1 odds, and player 4 wins 40 units based on her bet of 20 units and the 2-to-1 odds. Additionally, players 3 and 4 equally split the jackpot since the jackpot-winning hand was a "HEART FLUSH." Players 1, 2, and 5 lose their wagers.

EXAMPLE 3

In this example, there are seven players in the game and player 1 wagers 5 units, player 2 wagers 10 units, player 3 wagers 15 units, player 4 wagers 20 units, and players 5, 6, and 7 each wager 25 units to begin the round. The dealer deals the following initial cards to each hand:

| | INITIAL CARDS | | | | ODDS | FINAL CARDS |
|---|---|---|---|---|---|---|
| HAND 1 | 10♥ | J♦ | 8♣ | 4♣ | 4-1 | |
| HAND 2 | K♦ | 5♣ | A♥ | 10♦ | 4-1 | |
| HAND 3 | A♦ | K♠ | 5♦ | 3♥ | 5-1 | |
| HAND 4 | 7♣ | 6♠ | J♥ | K♥ | 5-1 | |
| HAND 5 | 3♣ | 9♣ | Q♥ | 9♠ | 1-1 | |
| HAND 6 | A♠ | 5♠ | A♣ | 5♥ | 1-1 | |
| HAND 7 | 8♦ | 4♦ | 10♠ | 10♣ | 4-1 | |

After dealing the cards, the dealer places the above odds-indicating cards next to each hand. The FIELD POSITION is then selected by the dealer as HAND 3 and HAND 4. The players then select their hands or position. Players 1, 3, 4, and 5 select HAND 6, players 2 and 6 select HAND 5, and player 7 selects the Field Position (i.e, HAND 3 or HAND 4). It should be noted that the odds on HAND 6 are 1 to 1 because all the other aces and fives appear in HANDS 2 and 3, and therefore, while HAND 5 could be the winning hand, it cannot get a full house. The odds on HAND 5 are 1 to 1 because the nine of Hearts and the nine of Diamonds have not been dealt. The jackpot wheel is activated and the jackpot-winning hand is determined to be "ANY STRAIGHT." The final cards are then dealt as follows:

| | INITIAL CARDS | | | | ODDS | FINAL CARDS | | |
|---|---|---|---|---|---|---|---|---|
| HAND 1 | 10♥ | J♦ | 8♣ | 4♣ | 4-1 | 8♠ | 2♠ | Q♦ |
| HAND 2 | K♦ | 5♣ | A♥ | 10♦ | 4-1 | 6♦ | 3♦ | 8♥ |
| HAND 3 | A♦ | K♠ | 5♦ | 3♥ | 5-1 | J♠ | 3♠ | 4♥ |
| HAND 4 | 7♣ | 6♠ | J♥ | K♥ | 5-1 | 7♠ | 9♦ | 7♥ |
| HAND 5 | 3♣ | 9♣ | Q♥ | 9♠ | 1-1 | Q♠ | 2♥ | 2♦ |
| HAND 6 | A♠ | 5♠ | A♣ | 5♥ | 1-1 | J♣ | 7♦ | 2♣ |
| HAND 7 | 8♦ | 4♦ | 10♠ | 10♣ | 4-1 | 4♠ | Q♣ | K♣ |

The winning hand is HAND 4, having three sevens. Player 7, who selected the field position comprising HAND 3 or HAND 4, wins 125 units based on her wager of 25 units and 5-to-1 odds of HAND 4. Players 1 through 6 all lose their wagers. No one wins the jackpot because the jackpot-winning hand was "ANY STRAIGHT."

EXAMPLE 4

In this example, there are ten players in the game, and players 1, 2, and 3 each wager 10 units, players 4, 5, and 6 each wager 20 units, and players 7, 8, 9, 10 each wager 30 units to begin the round. The dealer deals the following initial cards to each hand:

| | INITIAL CARDS | | | | ODDS | FINAL CARDS |
|---|---|---|---|---|---|---|
| HAND 1 | Q♦ | A♦ | A♠ | 2♥ | 2-1 | |
| HAND 2 | K♠ | 10♥ | Q♠ | 8♠ | 2-1 | |
| HAND 3 | 5♠ | J♥ | 5♣ | 2♠ | 3-1 | |
| HAND 4 | 3♣ | J♣ | 3♥ | K♥ | 3-1 | |
| HAND 5 | 6♦ | Q♥ | 5♦ | 7♦ | 3-1 | |
| HAND 6 | 9♦ | 8♣ | 5♥ | 2♦ | 5-1 | |
| HAND 7 | 8♦ | 3♦ | 4♦ | A♣ | 4-1 | |

After dealing the cards, the dealer places the above odds-indicating cards next to each hand. The FIELD POSITION is selected by the dealer as HAND 6 and HAND 7. The players then select their hands or position. Players 1 and 2 select position 8, the "No Two Pair Or Better", players 3 and 5 select the Field Position (i.e, HAND 6 or HAND 7), and players 4, 6, 7, 8, 9 and 10 select HAND 1. The jackpot wheel is activated and the jackpot-winning hand determined to be "ANY ACE HIGH FLUSH." The final cards are then dealt as follows:

| | INITIAL CARDS | | | | ODDS | FINAL CARDS | | |
|---|---|---|---|---|---|---|---|---|
| HAND 1 | Q♦ | A♦ | A♠ | 2♥ | 2-1 | 8♥ | 9♣ | 10♦ |
| HAND 2 | K♠ | 10♥ | Q♠ | 8♠ | 2-1 | Q♣ | 4♠ | 7♣ |
| HAND 3 | 5♠ | J♥ | 5♣ | 2♠ | 3-1 | 10♣ | A♥ | 4♣ |
| HAND 4 | 3♣ | J♣ | 3♥ | K♥ | 3-1 | 9♥ | 10♠ | 2♣ |
| HAND 5 | 6♦ | Q♥ | 5♦ | 7♦ | 3-1 | 7♥ | A♣ | J♠ |
| HAND 6 | 9♦ | 8♣ | 5♥ | 2♦ | 5-1 | 3♠ | 6♠ | 9♠ |
| HAND 7 | 8♦ | 3♦ | 4♦ | A♣ | 4-1 | 6♥ | 7♣ | K♦ |

In this example, no hand has two pair or better and the winning position is position 8. Players 1 and 2, who selected the "No Two Pair Or Better" position each win 60 units, based on their wagers of 10 units and their 6-to-1 odds. Players 3 through 10 all lose their wagers. No one wins the jackpot because the jackpot-winning hand was "ANY ACE HIGH FLUSH."

The method of and apparatus for the present invention is also appropriate for electronic devices. In the electronic version, the live dealer is replaced by computer/video poker machine 100, which implements the method of playing the game on a video screen 102 and uses a player control panel 104, as shown in FIG. 5. The video screen has an area for displaying hands one through seven, the odds for each hand, the odds for the "No Two Pair Or Better" position, the hands in the field position, the separate odds for the field position if desired, the amount of the jackpot, the jackpot wheel, the amount of the player's wager, and the player's hand/position selection. The player control panel 104 includes a slot for receiving tokens, coins, or chips, a DEAL button, a BET ONE button, a BET MAX button, PLAYER SELECTION buttons 1–9, a SPIN button, and a CASH OUT button.

To play this computer video poker machine, the player deposits one or more tokens, coins, or chips in the coin slot. The Player then hits the DEAL button. The computer deals and displays the initial four cards to each of the seven hands and sets and displays the odds for each hand. The computer may also determine and display the two hands of the field position in the area labeled "9 FIELD POSITION HANDS." The player then must select one of the hands or positions by hitting one of the nine PLAYER SELECTION buttons corresponding to HAND 1 through HAND 7, position 8 which is the NO TWO PAIR OR BETTER position, or position 9 which is the FIELD POSITION. The player may change his mind by hitting a different PLAYER SELECTION BUTTON until the player hits the SPIN button which locks in the player's selection and activates the jackpot wheel.

After the jackpot is determined, the additional cards are dealt to each hand and the winning hand is determined. If the player wins, she receives credits based on the odds for the hand or position and her wager. The player can cash out at the end of each round by hitting the CASHOUT button, or the player can build credits. If the player has credits, she can play the next round by hitting the BET ONE button one or more times or the BET MAX button, as is currently done on draw video poker machines.

It should be appreciated that the makeup of the board or the table could vary and that the method of the present invention could be utilized on a table without a board. It should be appreciated that the number of cards dealt to each hand could also vary and that the number of hands could also vary.

An alternative method of the present invention may be referred to as the seventh card variation. In this variation, the seventh card is not dealt to the hand or hands which are guaranteed losing hands. After the sixth card is dealt, the dealer determines which hands can possibly be winning hands and which hands cannot be winning hands. The hands that cannot be winning hands are removed from the table and any players that selected those hands lose their wagers which are collected by the dealer. The dealer then deals a seventh card to each of the possible winning hands and the winning hand is determined.

A further alternative method of the present invention is referred to as the common ending card(s) variation. In this variation, after the players select their hands or position, one or more of the additional cards are not dealt to each hand, but rather are placed in a neutral position. All of the hands share the card or cards placed in the neutral position to make up at least five cards needed for a poker hand.

Another alternative embodiment of the present invention is referred to as the second bet chance. In this variation, after a predetermined number of cards is dealt, such as after the sixth card is dealt but before the remaining cards such as before the seventh card is dealt, a second bet could be placed on any of the hands except for the best hand. Also a similar variation of the present invention is when one or more of the cards are dealt face down. A second wager may be placed before the cards dealt face down are turned face up.

It will be understood that modifications and variations may be effected without departing from the scope of the novel concepts of the present invention, but it is understood that this application is to be limited only by the scope of the appended claims.

The invention is hereby claimed as follows:

1. A method of playing a poker-like game with a deck of playing cards, each card having a face side displaying the value of the card, wherein at least one player plays against a house, said method comprising the following steps:

a) each player making a wager, b) the house dealing a predetermined like number of initial cards from the deck face up to a plurality of separate hands, c) the house associating odds with each hand depending on the chance of that hand being the winning hand and displaying said odds to said players in accordance with predetermined guidelines, d) each player selecting one of the hands, e) the house dealing a predetermined like number of additional cards from the deck face up to each of the separate hands such that the total number of initial and additional cards in each hand equals at least five from which a poker hand can be formed, f) the house determining a winning hand according to predetermined rules of order, and g) the house paying each player who selected the winning hand according to the player's wager and the odds associated with the winning hand and collecting each player's wager who did not select the winning hand.

2. The method of playing a poker-like game defined in claim 1, wherein during the step of the house dealing a predetermined number of initial cards to a plurality of hands the house deals four initial cards of the deck face up to seven separate hands after each player makes a wager.

3. The method of playing a poker-like game defined in claim 2, wherein during the step of the house dealing a predetermined number of additional cards the house deals three additional cards of the deck face up to the seven separate hands after the players have selected their hands.

4. The method of playing a poker-like game defined in claim 1, wherein during the steps of the house dealing a predetermined number of initial and additional cards to the hands the total number of cards dealt to each hand is seven.

5. The method of playing a poker-like game defined in claim 1, which further includes the step of determining a jackpot-winning hand, and wherein each player who selected the winning hand which corresponds to the jackpot-winning hand wins at least a part of a jackpot.

6. The method of playing a poker-like game defined in claim 1, which further includes the step of determining a jackpot-winning hand, and wherein each player who selected a hand which corresponds to the jackpot-winning hand wins at least a part of a jackpot.

7. The method of playing a poker-like game defined in claim 1, which further includes the step of the house selecting at least two hands to be a field position, and wherein each player selecting the field position wins if either hand selected as the field position is the winning hand.

8. The method of claim 1, wherein the house is a dealer.

9. The method of claim 1, wherein the house is an electronic apparatus.

10. A method of playing a poker-like game with a deck of fifty-two playing cards, each card having a face side displaying the value of the card, wherein at least one player plays against a dealer, said method comprising the following steps:

a) each player making a wager, b) the dealer dealing a predetermined like number of initial cards from the deck face up to a plurality of separate hands, c) the dealer placing odds on each hand depending on the chance of that hand being the winning hand and displaying said odds to said players in accordance with predetermined guidelines, d) each player selecting one of the hands or a no-hand winning position having predetermined odds, e) the dealer dealing a predetermined like number of additional cards from the deck face up to each of the separate hands such that the total number of cards in each hand equals at least five from which a poker hand can be formed, f) the dealer determining a winning hand or position according to predetermined rules of order, and g) the dealer paying each player who selected the winning hand or position according to the player's wager and the odds placed on the winning hand or position and collecting each player's wager who did not select the winning hand or position.

11. The method of playing a poker-like game defined in claim 10, wherein during the step of the dealer dealing a predetermined number of initial cards to a plurality of hands the dealer deals four initial cards of the deck face up to seven separate hands after each player makes a wager.

12. The method of playing a poker-like game defined in claim 11, wherein during the step of the dealer dealing a predetermined number of additional cards the dealer deals three additional cards of the deck face up to the seven separate hands after the players have selected their hand or position.

13. The method of playing a poker-like game defined in claim 10, wherein during the steps of the dealer dealing a predetermined number of initial and additional cards to the hands the total number of cards dealt to each hand is seven.

14. The method of playing a poker-like game defined in claim 10, which further includes the dealer selecting at least two of the hands as a field position after placing odds on each hand, wherein each player selects one of the hands, the field position, or no-hand winning position, and wherein the dealer pays each player who selected the field position if any of the hands in the field position wins.

15. An apparatus for playing a poker-like game in which at least one player plays against a house, said apparatus comprising:

a deck of fifty-two playing cards, means for indicating each player's wager, means for displaying the cards initially dealt to a plurality of separate hands, means for determining and displaying odds placed on each hand by the house depending on the chance of that hand being the winning hand in accordance with predetermined guidelines, means for indicating player selection of a hand, and means for displaying the cards additionally dealt to each of the separate hands, whereby the house determines the winning hand according to predetermined rules of order and pays each player who selected the winning hand according to the odds determined for that hand and collects each player wager who did not select the winning hand.

16. The apparatus for playing the poker-like game of claim 15, which further includes means for determining a jackpot-winning hand.

17. The apparatus for playing the poker-like game of claim 16, wherein the jackpot-winning hand determining means includes a wheel having a plurality of indicating means for predetermined number of winning hands and means for randomly selecting one of said indicating means.

18. An apparatus for playing a poker-like game in which at least one player plays against a dealer, said apparatus comprising:

a deck of fifty-two playing cards, means for indicating each player's wager, board means for providing predetermined positions for the display of a plurality of cards in a plurality of hands, means for determining and displaying odds placed on each hand by the dealer, depending on the chance of that hand being the winning hand in accordance with predetermined guidelines, and means for indicating each players selection of a hand.

19. An electronic apparatus for playing a poker-like game in which at least one player plays against a computer, representing a house, said apparatus comprising:

means for simulating a deck of fifty-two cards, means for dealing an initial number of said cards to a plurality of hands, means for accepting and indicating each player's wager, means for displaying said plurality of cards in said plurality of hands, means for determining and displaying odds associated with each hand depending on the chance of that hand being the winning hand in accordance with predetermined guidelines, means for allowing a player to select one of said hands;

means for indicating each of said player's selection of a hand;

means for dealing an additional number of said cards to said plurality of hands; and means for determining whether each player wins or loses.

* * * * *